US005645278A

United States Patent [19]

Harris

[11] Patent Number: 5,645,278

[45] Date of Patent: Jul. 8, 1997

[54] THREE-DIMENSIONAL BALL-IN-TRACK PUZZLE

[76] Inventor: John D. Harris, 22475 Parton, Santa Ana, Calif. 92707-2624

[21] Appl. No.: 594,646

[22] Filed: Feb. 2, 1996

Related U.S. Application Data

[63] Continuation-in-part of Ser. No. 306,391, Sep. 15, 1994, abandoned.

[51] Int. Cl.[6] ..... A63F 9/08

[52] U.S. Cl. ..... 273/153 S

[58] Field of Search ..... 273/153 R, 153 S, 273/155, 157 R

[56] References Cited

U.S. PATENT DOCUMENTS

| | | | |
|---|---|---|---|
| 3,815,280 | 6/1974 | Gilfillan | 273/155 |
| 4,767,120 | 8/1988 | Ho | 273/153 S |
| 4,832,343 | 5/1989 | Bernat | 273/153 S |
| 4,871,173 | 10/1989 | Lammertink | 273/153 S |
| 4,881,738 | 11/1989 | Ayers | 273/153 S |
| 5,110,130 | 5/1992 | Aulicino | 273/153 S |
| 5,114,148 | 5/1992 | Liu | 273/153 S |
| 5,267,731 | 12/1993 | Gruber | 273/153 S |
| 5,299,804 | 4/1994 | Stevens | 273/155 |

FOREIGN PATENT DOCUMENTS

| | | | |
|---|---|---|---|
| 1724293 | 4/1992 | U.S.S.R. | 273/153 S |

*Primary Examiner*—Steven Wong
*Attorney, Agent, or Firm*—Frank C. Price

[57] ABSTRACT

An amusement device comprises six rigid bodies permanently connected via six pivots in a closed loop, each body containing a track segment or track segments bearing game pieces movable in the track segments. Axes of the pivots form a symmetrical pattern around a line of symmetry, and as a consequence, the pivots allow the rigid bodies to be reoriented by a player, so as to align different track segments end to end. Game pieces can then be moved from one track segment to another. The object of play is to arrange game pieces in a specific pattern among the six bodies.

2 Claims, 9 Drawing Sheets

FIG. 9

| | 1 | 2 | 3 | 4 | 5 | 6 |
|---|---|---|---|---|---|---|
| RIGHT | R | R | B | B | Y | Y |
| LEFT | R | V | B | V | Y | V |

THREE-DIMENSIONAL BALL-IN-TRACK PUZZLE

This application is a Continuation-in-Part for application Ser. No. 08/306,391 filed Sep. 15, 1994, now abandoned.

RELATED PATENTS

| | | |
|---|---|---|
| Lammertink | 4,871,173 | Oct 3, 1989 |
| Liu | 5,114,148 | May 19, 1992 |
| Ho | 4,767,120 | Aug 30, 1988 |
| Stevens | 5,299,804 | Apr 5, 1994 |
| Aulicino | 5,110,130 | May 5, 1992 |
| Bernat | 4,832,343 | May 23, 1989 |
| Gilfillan | 3,815,280 | Jun 11, 1974 |

BACKGROUND OF THE INVENTION

This invention relates to an amusement device, more particularly to a puzzle device.

Manipulative puzzles whose object is to arrange game pieces into a particular order have enjoyed popularity for centuries. Similar to the current invention are "Shunting Puzzles". Puzzles of this type can be generally characterized as having a series of game pieces arranged in a linear fashion, with some visual characteristic for distinguishing one game piece from another, arranged on a track so that the game pieces may slide along the track. The track is designed in such a way that game pieces may be moved to change the relative relationships with each other, thereby accomplishing the object of these puzzles.

U.S. Pat. No. 4,871,173 by Lammertink, U.S. Pat. No. 4,832,343 by Bernat, U.S. Pat. No. 5,110,130 by Auliclno and U.S. Pat. No. 5,114,148 by Liu describe closed tracks comprising track segments on rigid bodies. U.S. Pat. No. 4,767,120 by Ho, U.S. Pat. No. 5,299,804 by Stevens, U.S. Pat. No. 3,815,280 by Gilfillan, and Aulicino just mentioned describe connection of rigid bodies via pivots in a continuous loop, although none of these specifies six bodies in a loop. Of those mentioned, the author considers Bernat to be closest in function to the present invention.

Bernat describes a series of track segments whose movements are confined by way of connecting pieces, but which can be moved into various positions in which the track segments combine to make a closed track. Track segments are completely filled with game pieces, but may be moved simultaneously along any such closed track. The Bernat puzzle is solved by alternating movement of track segments to form closed tracks with movement of game pieces within closed tracks thus formed.

The advantage of the current device over other mechanical puzzles is not in the difficulty of finding a solution, but in the fascination kindled by 3-dimensional movement of a structure that at first appears immovable. This movement is the feature which makes the current device unique.

Basic Concept

The designing of embodiments of this device other than the one described below is based on an understanding of why a symmetrical pattern of six pivots connecting consecutive bodies in a loop is advantageous. A discussion of theory follows.

Mentally assembling a device while cautiously counting the number of dimensions of movement gained and lost when each piece is introduced can reveal mobility, or lack thereof, within that device. Caution is advised because sometimes a restriction seen by mathematical analysis allows movement only in an imaginary direction, which translates into immobility. On the other hand, a limitation of movement which is redundant will eliminate less movement than expected. There is redundancy in the current device in a way which is not obvious. The following hypothetical assembly without imposing symmetry will suggest immobility of the axes. A second assembly with symmetry imposed will allow movement.

For the first assembly, symmetry is not imposed and it is assumed that movement restrictions are independent, i.e. not redundant. Placement of a line in space has four dimensions of movement. I.e. within any suitable fixed frame of reference, four numbers would be required to uniquely express its position and orientation. Independent movement of six such lines would thus have twenty-four dimensions of movement. Whenever a moveable but rigid body is introduced and two of these lines are held rigid with respect to this body, both the shortest distance between the two lines and the angle between the directions of them become fixed. These two restrictions being given and constant, two of the total dimensions can be determined by all others, so that the dimension count will decrease by two. Six such rigid bodies are introduced, so as to involve said lines and rigid bodies alternately in a loop. This decreases the original dimension count of twenty-four by twelve (2×6), leaving twelve dimensions of movement. Whenever any two rigid bodies that involve a common line are then actually connected with a pivot, that line becomes a pivot axis. Translation of one body with respect to the other is denied, thus subtracting one dimension. Six such pivots are formed, thus subtracting six from the twelve dimensions present at this point, leaving six. Since there is no stationary connection of any part to the frame of reference, six dimensions are necessary to locate and orient the entire group within space. If six dimensions of movement are remaining and six are required to locate and orient the agglomeration of bodies, then movement within the agglomeration is not possible.

One may generalize, and consider n bodies connected in similar fashion. The number of dimensions of freedom is similarly anticipated to be n−6 when n is 6 or greater. As mentioned above, movement might be mathematically possible only in an imaginary direction, as when each of eight rigid bodies hold consecutive axes to intersect at 135 degrees, resulting in an immobile octagon of axes.

Returning to the original case of six axes for the second mental assembly, a line of symmetry is imposed. This line of symmetry has four dimensions of movement. Likewise, proposing a first pivot axis anywhere in space adds four dimensions, but the position of its symmetrical counterpart is thereby determined. Thus, placing pivot axes while imposing symmetry but not yet considering which lines are connected with rigid bodies, the axes will add twelve dimensions in place of the twenty-four involved in the first mental assembly. The sum is now sixteen. Similarly, every restriction made between parts in one place will impose the same restriction between symmetrical counterparts, thus cutting in half the number of dimensions lost. Instead of subtracting twelve when rigid bodies are introduced, only six are subtracted, to leave ten. Instead of subtracting six when pivots are put in place, three are subtracted. The result is seven, in place of the six in the first assembly. Allowing the six dimensions of location and orientation of the group, this allows one dimension of movement within the group.

Line symmetry is thus one way that exactly six axes may be made to be moveable. If we generalize the above, the indication is that a loop of n rigid bodies, where n must now be even, built with bodies to allow line symmetry and confined to that symmetry by whatever means during movement, we find that n/2–2 dimensions of movement should exist. For eight bodies, the original n–6=2 dimensions are retained. Above eight, symmetry is confining rather than liberating. Below six, line symmetry by itself offers no additional dimensionality. Therefore, a figure of six axes is unique in this regard.

Without imposing symmetry, a loop of seven rigid bodies in general has one dimension of movement; however, considering small movements to or from any specific orientation, some pivots experience larger movements compared to those on the other side of the loop. Designing track segments that will align is a far more challenging exercise than it is with six. Use of six rigid bodies causes the pivot action to be more evenly distributed around the loop.

BRIEF SUMMARY OF THE INVENTION

The current device comprises six rigid bodies, retained in a loop via pivots whose axes form a symmetrical pattern around a line, and track segments on the surface of each of the six rigid bodies, and game pieces which are retained in those track segments. Different groups of pieces of different given colors make up the pieces in the track. The track segments are arranged so that the movement discussed above causes various subsets of track segments to align end to end while blocking exit of game pieces from other segments or segment groups. Game pieces may pass from one track segment to another when the track segments are aligned end to end, provided that such movement would not cause capacity of the target segment or segment group to be exceeded. By alternating the movement of the rigid bodies with movement of game pieces within the track segments, game pieces can be rearranged along the track to conform to a desired pattern of colors. To assure that the predefined pattern is attainable, the game pieces can be loaded in the desired pattern when the puzzle is constructed. Since individual moves are reversible, any mixing of game pieces within the confines of the constructed puzzle will lead to a position of game pieces from which the desired pattern can be recovered.

BRIEF DESCRIPTION OF THE DRAWINGS

The drawings illustrate the preferred embodiment of the invention. Hidden lines, shading, colors, and coring have been omitted for clarity.

FIG. 9 is a worksheet wherewith colors of rigid bodies and game pieces may be chosen.

DETAILED DESCRIPTION

Figure 1:
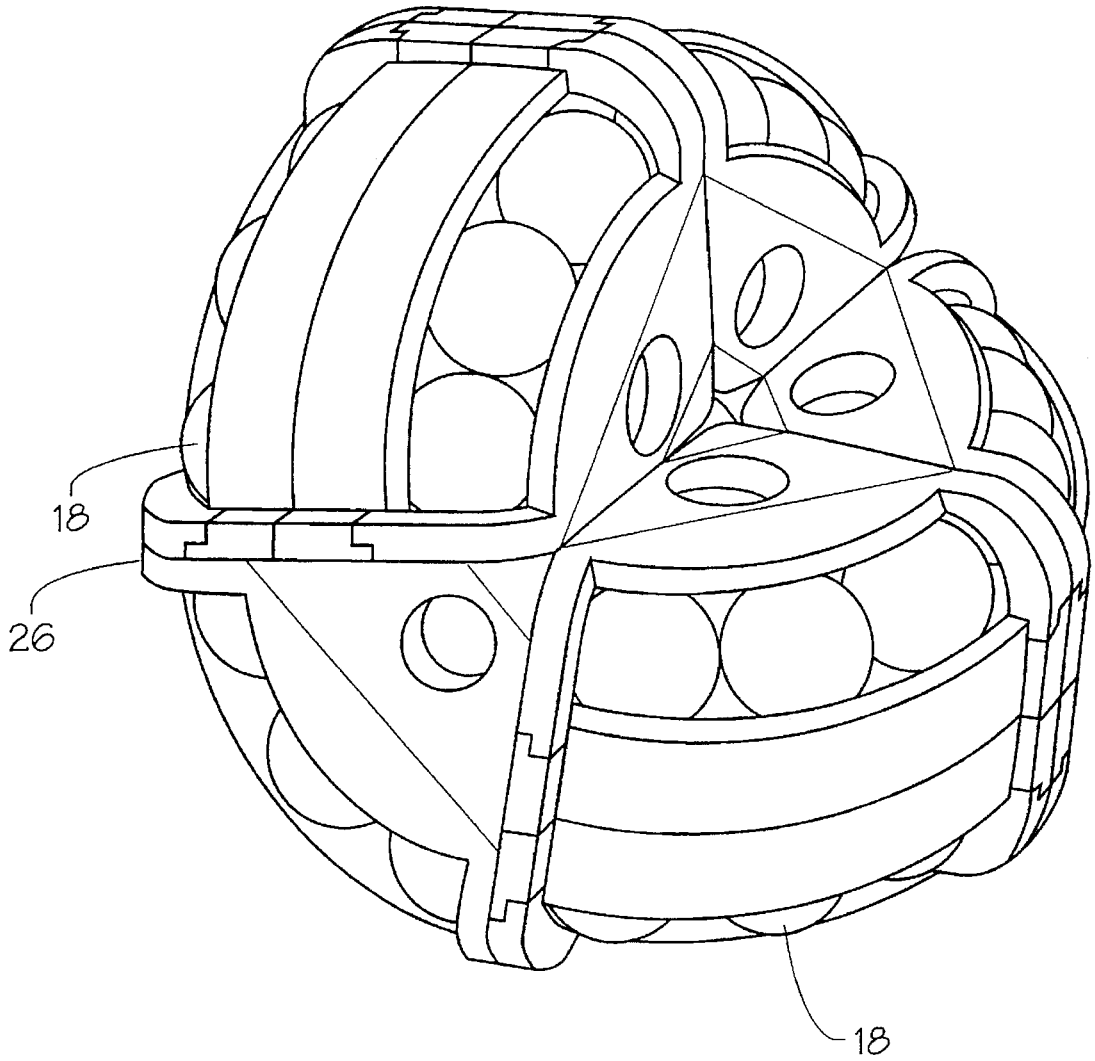
FIG. 1 is a perspective view of the preferred embodiment, in an orientation of rigid bodies which forms a closed track.
Figure 2:
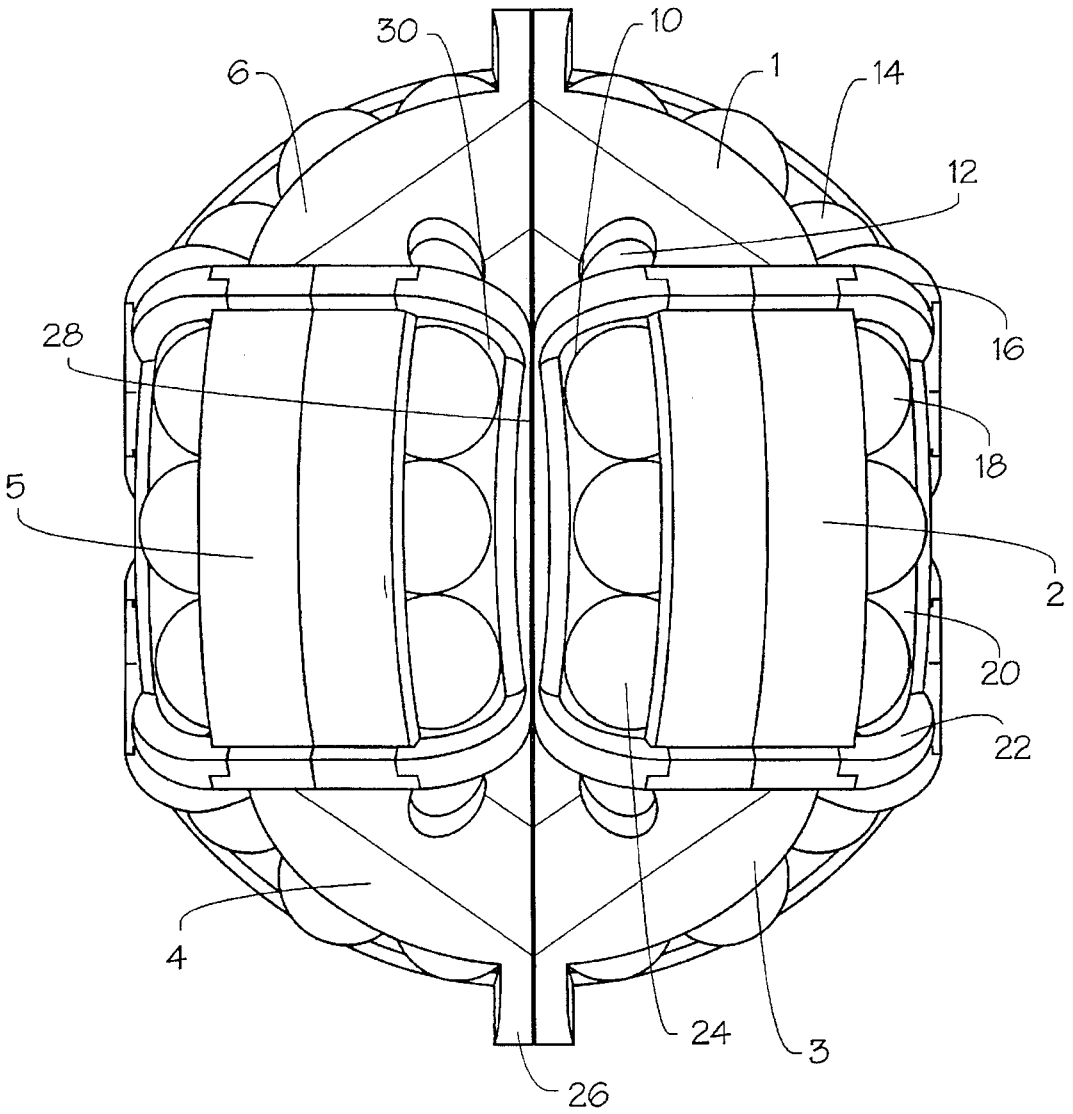
FIG. 2 is the same orientation, but viewed along the line of symmetry. The eighteen game pieces in the closed track can all be seen at or near the perimeter of the figure.

The preferred embodiment is shown in perspective view in FIG. 1, and along the axis of symmetry in FIG. 2. Rigid bodies 1–6 of FIG. 2 are made of colored plastic, except for the aluminum rivets such as 12 of FIG. 2 which hold them together. Game pieces such as 18 of FIG. 2 are made of white nylon balls which are dyed as needed to match colors of the rigid bodies. Color is discussed later.

Track segments such as 20 of FIG. 2 are completely filled with game pieces. Game pieces should not be removable from the device, so all ends of track segments such as 30 and 10 not aligning with other track segments are blocked by neighboring bodies such as 6 and 1 respectively. Thus, for game pieces to move, track segments must align to form a closed track. All eighteen game pieces in a typical closed track thus formed are visible at or near the perimeter of FIG. 2. Game piece 18 is one of these eighteen. This closed track always comprises six track segments, one on each of rigid bodies 1–6. Each rigid body is equipped with two track segments, one of which will hold game pieces immovable whenever the other is part of a closed track. In the orientation of rigid bodies shown in FIG. 2, game piece 24 and the other five game pieces near the center of the figure cannot move along the track segments, and twelve more, not showing, are likewise blocked from moving. Finger guards such as 26 serve to keep player from pinching fingers when the pivot axes are made to rotate.

Figure 3:
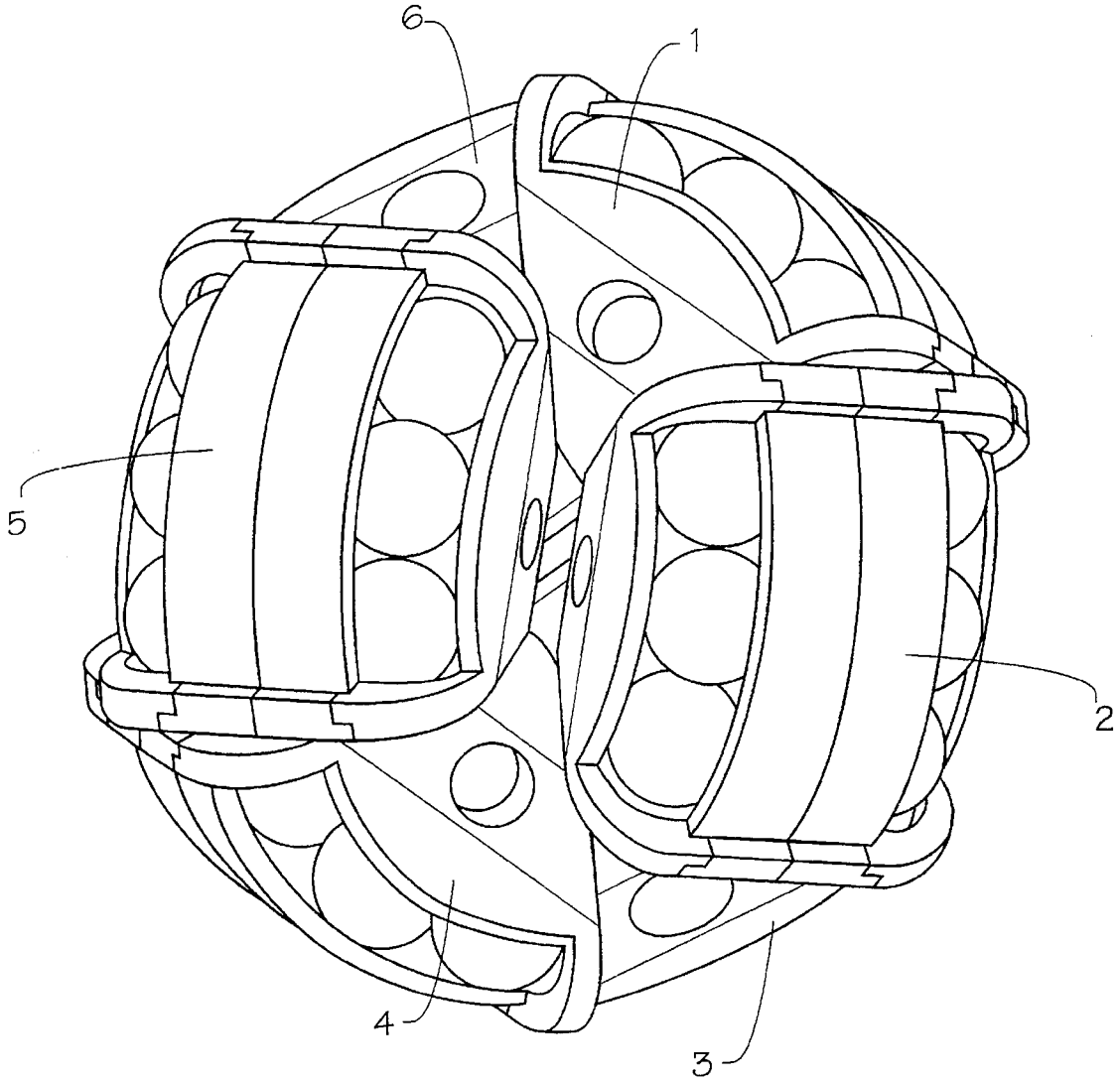
FIG. 3 is a different orientation, half-way between orientations of FIGS. 2 and 4. Again, it is viewed along the line of symmetry.
Figure 4:
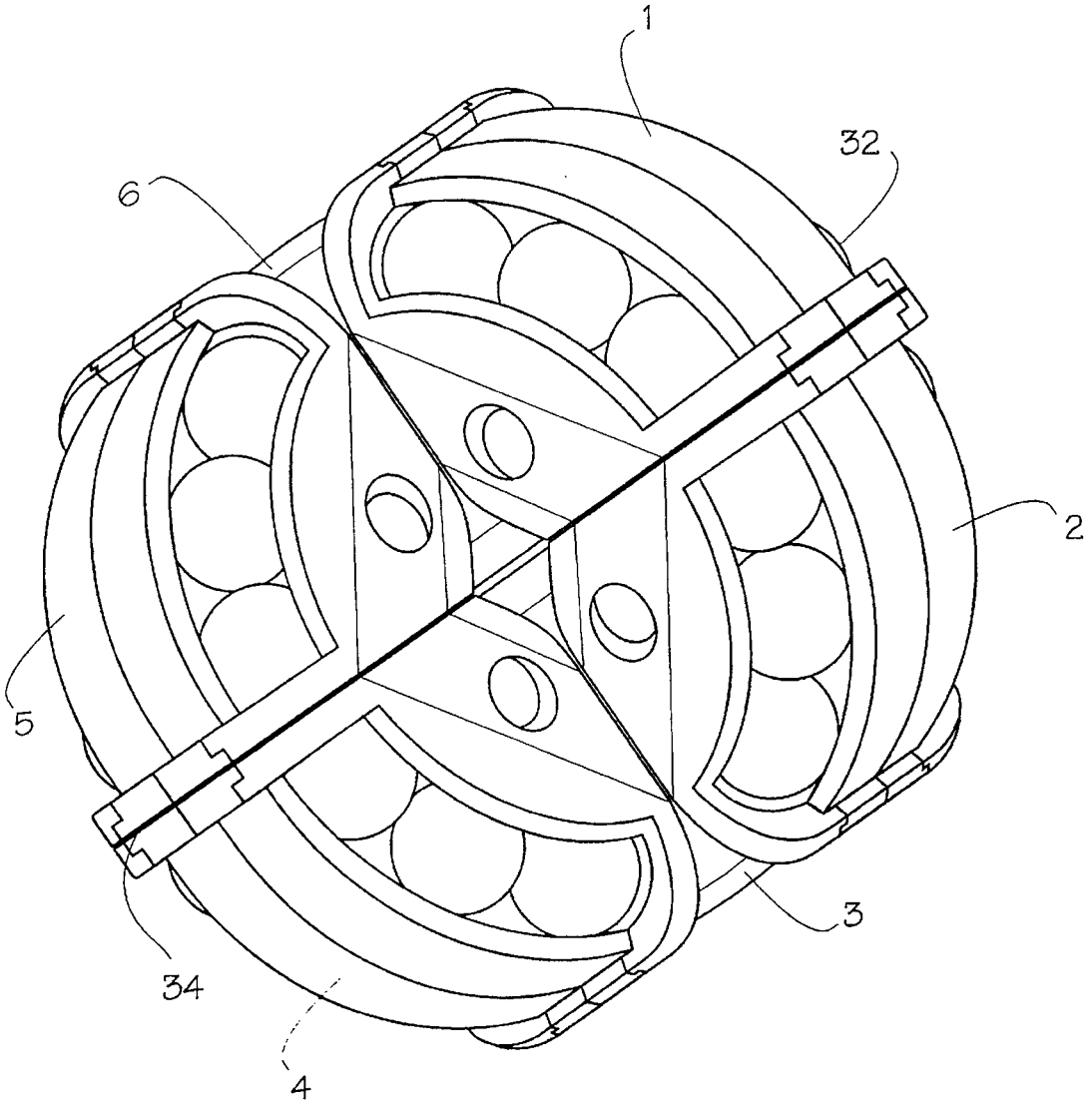
FIG. 4 is an alternate orientation which, like that of FIGS. 1 and 2, forms a closed track. Again, it is viewed along the line of symmetry.

Beginning with the orientation of FIG. 2, if a player compels rigid bodies 3 and 6 to move towards each other, all six rigid bodies move, first to positions shown in FIG. 3, and then on to positions in FIG. 4. FIGS. 3 and 4, like FIG. 2, are seen along the axis of symmetry. The result is an orientation which is congruent to the first. A new closed track has been formed, and of the eighteen game pieces in that closed track, only four are visible in FIG. 4, of which 32 is one. The other twelve game pieces showing in FIG. 4 may not be moved, for they are blocked by rigid bodies 3 and 6. Six more, not showing, are likewise blocked from moving. Game pieces, all similar in shape to 18 of FIG. 2, are made spherical to allow some misalignment of the game piece boundaries such as that between 18 and 14 with rigid body boundaries such as 16, when player desires to reorient the rigid bodies. If boundaries are misaligned to a limited degree, rotation of pivots moves game pieces so that boundaries align.

Figure 5:
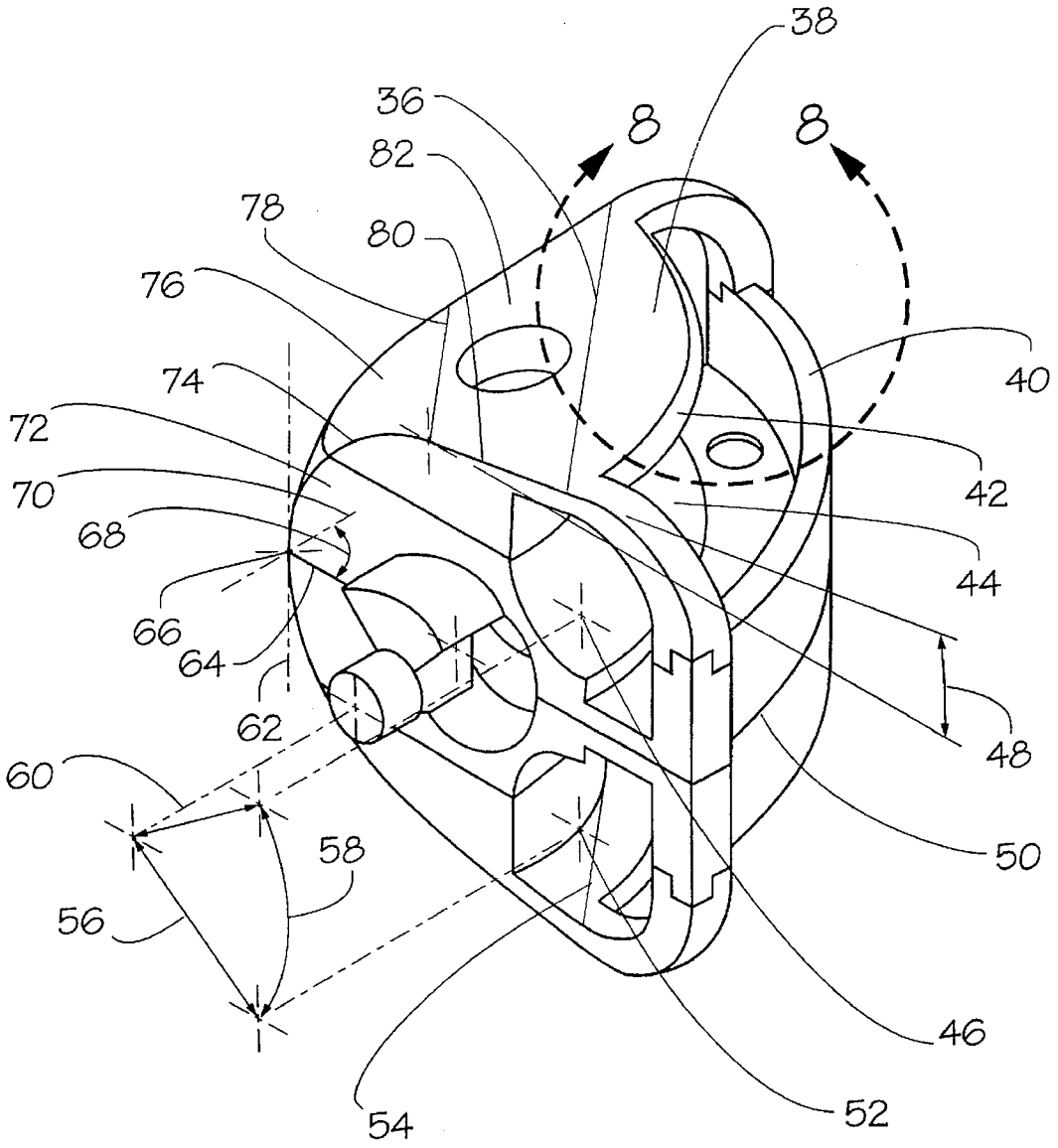
FIG. 5 is an isometric view of one of the six rigid bodies. Game pieces are omitted to expose details of track segments.

For ease of manufacture and for aesthetic simplicity, the six rigid bodies are made identically shaped. FIG. 5 shows a typical rigid body. While each rigid body has the responsibility of blocking the exit of game pieces from the neighboring rigid body, it is sufficient to cover only part of the end of any track segment. Thus the face of a rigid body (72 of FIG. 5) has a radius at 74 equal to the distance 56 from the pivot axis 60 to the center of the track segment 52.

In FIG. 2, one sees that edge 28 of rigid body 5 comes very close to the corresponding edge of rigid body 2. Rigid bodies were designed specifically for this to happen. The gap seen represents the 0.010–0.020 inch gaps held by the pivot mechanisms connecting rigid body 1 to 6, and 3 to 4. As drawn, it is a bit wider because of a compromise made in the calculations, discussed below. The wall can be thickened here so that pieces do meet, although such is not shown. Then, when the device is grasped via the outside surfaces of rigid bodies 2 and 5, the surfaces contact, and the friction between surfaces helps to maintain the orientation of rigid bodies while the game pieces are being repositioned along the tracks with the player's other hand.

Shape of a Single Rigid Body

The predominant shape of a single rigid body shown in FIG. 5 is that of a circular sweep around the line 62, which line is tangent to arc 74 at point 66. Surface 72 and its symmetrical counterpart not seen meet at point 66. If extended, they would intersect at line 62. Both are perpendicular to the median plane 50. Line 64 in plane 72 and its symmetrical counterpart 70, shown as a hidden line, are both in median plane 50. Angle 68 is therefore the angle between plane 72 and the rear plane which contains line 70. Game pieces, which have been omitted from this figure, travel through points 46 and 52. Lips 40 and 42 and back support 44 allow game pieces to move only parallel to these three features. The three thus form a track segment. This track segment is made to meet the pivot face at a right angle, so as to allow a smooth movement of game pieces to the track segment of an adjoining rigid body. The rigid body is sized so as to house exactly three game pieces in each of its two track segments.

While the predominant shape of the rigid body is a circular sweep, contrary to this predominant shape is surface 82, which is made planar, in order to allow the contact just described between rigid body pairs such as 2 and 5 in FIG. 2. Surface 38 of FIG. 5 is transitional, being parallel to the median plane 50 and thus conforming to the geometry of the sweep, while meeting planar surface 82 at a well-defined straight line 36. To maintain somewhat constant wall thickness, the underside of lip 42 has a break line similar to 36. This line is not seen, but its symmetrical counterpart 54 is seen. The edge 78 of surface 82 interfaces with curved surface 76. For geometrical simplicity of this interface, surface 76 is made to be a linear sweep of the arc 74, rather than a circular sweep that one might expect. Although this might be expected to cause interference between rigid bodies 2 and 6 in FIG. 3, the 0.010–0.020 gap left between abutting faces at each pivot clears up the conflict.

Figuring Dimensions

Values listed here are offered to verify the adoption of formulas and methods, and are not guaranteed suitable for construction. If not specified, measurements are in inches. Angle 68 in FIG. 5 varies independently, as do the game piece diameter and the thickness of lip 42. After multiple iterations (as will be explained below), the following values are found:

Angle 68=80.578 degrees by trial and error. See below for discussion.

Game piece diameter=7/16.

Thickness of retainer lip 42=1/16. The need for clearance surrounding game pieces is ignored for the following calculations.

The following values are computed in the sequence listed using *Mathematica* by Wolfram Research, (217)398-0700. *Mathematica* retains more digits than it displays, which would account for small discrepancies.

Angle 58 at the pivot axis 60, in a plane perpendicular to 60, between the centers 52 and 46 of the two track segments=78.7115 degrees. The relationship used is:

cos(angle 58)=cot(angle 68)cot((angle 68)/2).

The radius of the sweep of the center point of either track segment around line 62=0.941867. This calculation ignores the 0.010–0.020 inch gap between neighboring rigid body faces. There needs to be some extra space anyway.

The distance from the point 66 to the pivot axis 60=0.531161. This is also the radius of arc 74.

The distance from either point 46 or point 52 to the median plane 50=0.336827.

The inclination 48 of line 80 relative to plane 50=11.289 degrees. The computation of this one is an approximation. It assumes that the distance from point 46 of FIG. 5 to line 80 is half a game piece diameter plus the wall thickness of 1/16 inch, which is not strictly true. It is, however, close enough.

Looking at FIG. 2, one defines the pivot rotation angle between bodies 1 and 6 to be zero, and observes that the pivot rotation angle between bodies 5 and 6 is then equal to angle 58 of FIG. 5. In order to make the abutting surfaces of bodies 2 and 5 parallel, angle 48 should be the complement of angle 58 described above. The difference in this last iteration was 0.000489372 degrees, with which the author was satisfied.

The above calculations are computed with various values for angle 68. The resulting difference in the last step can be brought arbitrarily close to zero. At the value angle 68=80.578, the total angular measure of the closed track is 6×80.578, or approximately 483 degrees. As mentioned earlier, an earlier model with pivot axes meeting within rigid bodies at right angles, this total was 6×90, of 540 degrees.

One other dimension requires special attention. Because of the way in which pivot mechanisms are constructed, which is discussed below, one wants to know the maximum swing required of each pivot. It can be found by the following equation. Note that this equation is valid in the vicinity of angle 68=80.578, but with some lower numbers, the ArcSin function is in a different quadrant and one needs to drop "180 degrees −" after the equal sign. The cutoff point is not known. Let C be the angle of maximum rotation away from a central position required of a pivot mechanism. By symmetry, an equal deviation in the opposite direction will cause the total swing from one extreme to the other to be 2C. With angle 68 defined as above, $$C = 180\text{ degrees} - \arcsin((csc(\text{angle } 68)\ \hat{}\ 2(2+\cos(\text{angle } 68)+ sqrt(3)\sin(\text{angle } 68))sqrt(\cos((\text{angle } 68)/2)\ \hat{}\ 2(-9-3\cos(\text{angle } 68)+ 3\cos(2x\text{angle } 68)+7sqrt(3)\sin(\text{angle } 68)+sqrt(3)\sin(2x\text{angle } 68))))/(1+\cos(\text{angle } 68).))$$

When angle 68=80.578 as above, C=94.832, and 2C=189.665.

Construction of Rigid Bodies

For the sake of forming a pivot mechanism and of making rigid bodies in two different colors, each rigid body is made of separate, identically shaped halves. Each half is made of two separate parts to avoid undercuts in the molding process where the track segment is formed.

Figure 6:
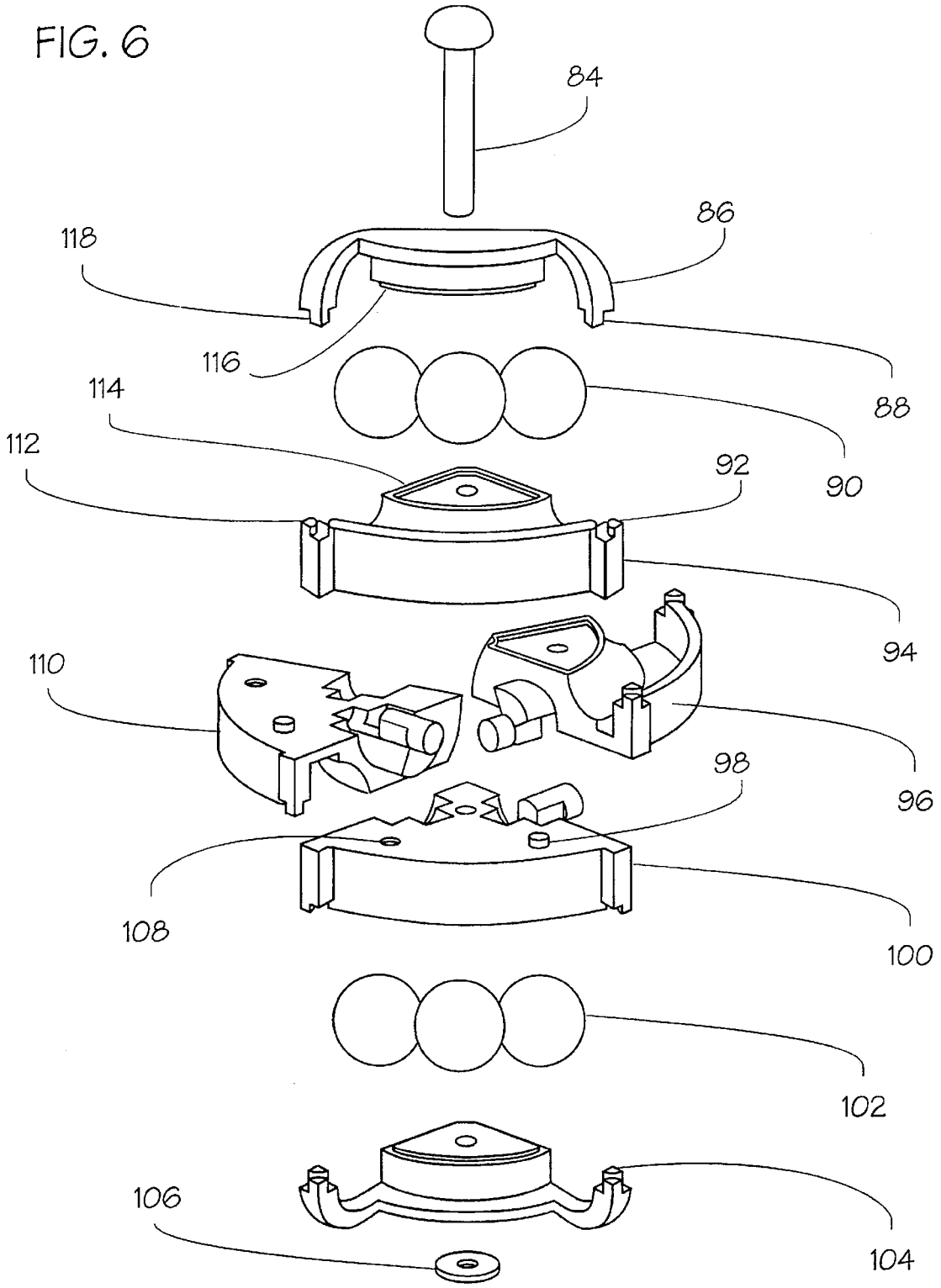
FIG. 6 is an exploded view of the first assembly of a rigid body. Game pieces are also shown for illustration, although they would not normally be in place until the final rigid body is assembled. Two pieces of neighboring rigid bodies are shown because they must be in place during the assembly.

FIG. 6 shows parts needed in order to assemble a first rigid body. The six game pieces identified as 90 and 102 need not be in the assembly until the last rigid body is assembled, and are shown only for illustration of their ultimate positions within the assembly. Pieces 110 and 96 are shown because they cannot be inserted after the rigid body is riveted together and must therefore be in place for the assembly. Pieces 86 and 94 are identical in shape with 104 and 100 respectively.

Parts 86, 94, 100, and 104 are held together with extra long blind rivet 84. Washer 106 is added because of the softness of the plastic relative to the soft aluminum rivet. An alternative is to force a cylindrical rod into a tapered hexagonal hole, fitting just tightly enough to hold the assembly securely without danger of breaking the hexagonal casing. Since the two pieces 86 and 104 are identical, each would have a hexagonal hole, and the rod could be cut from round stock readily available. Its length could be adjusted by experimentation. The rivet, while perhaps not the best long-term solution, is adequate.

Because the rivet is round, parts of the rigid body could be misaligned if provisions were not made to orient the parts being held together. Part 94 is therefore equipped with internal lip 114 to fit into perimeter groove 116 on part 86. Part 100 in turn is held in position via peg 98 and hole 108 fitting with similar hole and peg not seen on identical part 94. Parts 104 and 100, being identical in shape to 86 and 94, are similarly held in place by lip and groove.

A second rigid body is formed by similar assembly, allowing parts 100 and 96 to substitute for parts 110 and 94 respectively, while introducing six new parts for the others shown (omitting the game pieces). This process is continued, using pivot mechanisms already formed to rotate finished rigid bodies to such a position as to not interfere with new construction, until the chain of bodies comprises five finished bodies with two additional pieces similar to 110 and 96 protruding from the ends of the chain. At this point, game pieces are introduced. By manipulating the pivot axes, 30 game pieces may be made to completely fill those track segments already assembled. Six more game pieces must be held in place while the last rigid body is assembled.

The Pivot Mechanism

Figure 7:
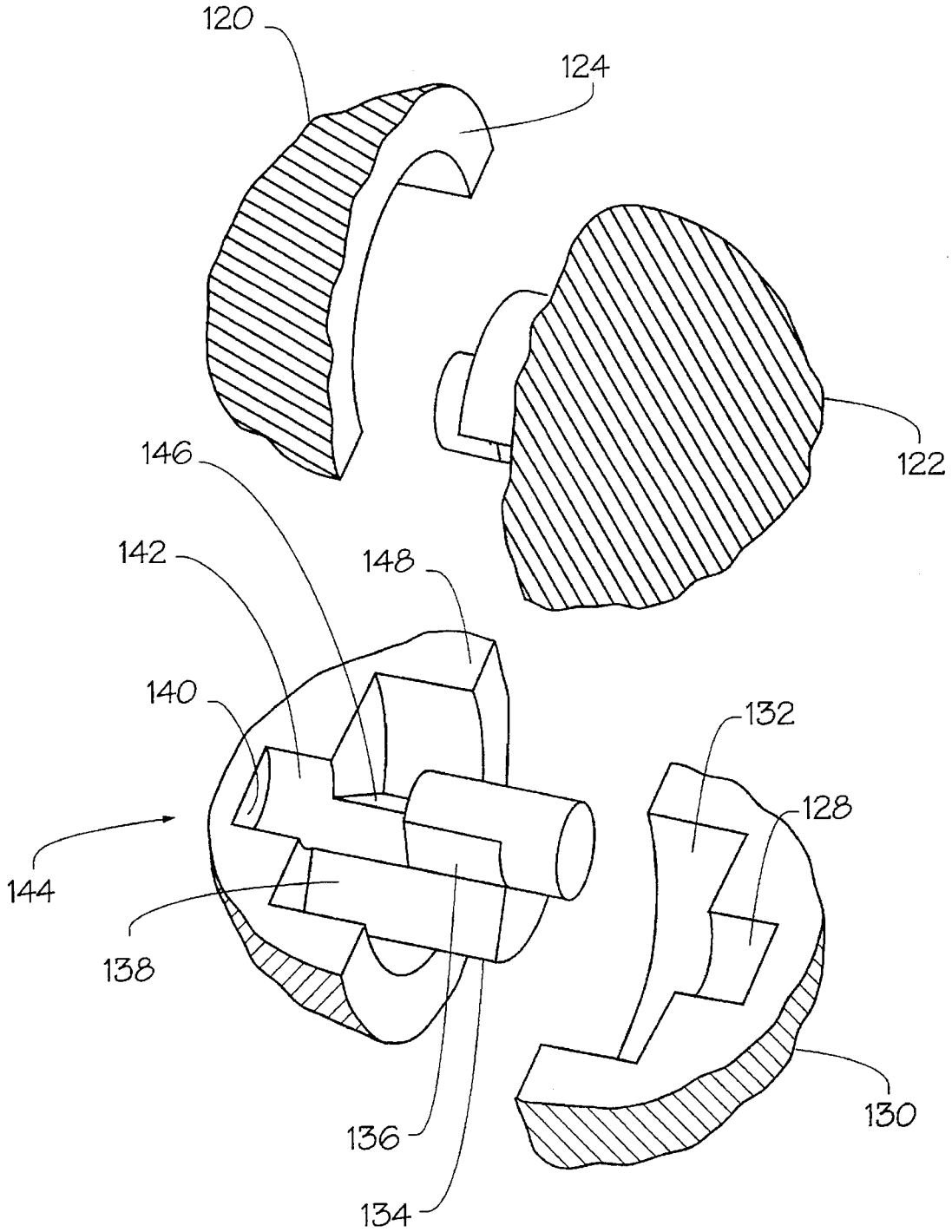
FIG. 7 is a perspective view of spherical sections of four inner pieces that come together to form a pivot mechanism. Two of the four are drawn larger to clarify various features thereon. Features not relevant to the pivot mechanism have been omitted for clarity.

As discussed before, the movement of each pivot in the preferred embodiment is limited to a range which is approximately 189.665 degrees between extremes, which is substantially less than 360 degrees. In consequence, pivots may be constructed in an unusual manner which eliminates the need for additional parts. Point 34 on FIG. 4 shows the coming together of four parts, all similar in shape to part 100 of FIG. 6. FIG. 7 shows spherical sections of these four parts, 144, 130, 120, and 122. Sections 144 and 130 are drawn larger so as to display details. Section 122 is identical in shape to section 144, and section 120 is identical in shape to section 130. Reference indices defined on sections 144 and 130 will also be used here to refer to corresponding features on sections 122 and 120. All four sections are oriented as they would be if the pivot mechanism were assembled.

Whereas a more familiar pivot mechanism would comprise two bearings supporting a single shaft, the preferred embodiment employs pivots comprising two bearings each being an integral part of one of the two engaged rigid bodies, holding two shafts, each of which is an integral part of the opposite rigid body. Sections 130 and 122 come together when one rigid body is assembled. Cutouts 128 of section 130 and 142 of section 122 form a bearing to support shaft 126 of section 144. One sees that the shaft is an extension of section 144 held rigid via connective structure 134 of section 144. In similar fashion, cutouts 142 of section 144 and 128 of section 120 form a bearing for shaft 126 of section 122, which is an extension of section 122, held via connective structure 134 of section 122.

Parts are sized so that the connective structures do not contact the opposite rigid bodies. The two shafts 126 are held concentric only by surfaces 142 and surfaces 128. Surface 140 on section 144, together with the semicircular complementary surface not seen on section 120 hold shaft 126 of section 122 so that surfaces 124 can come up to only 0.010 inches away from their symmetrical counterparts. In the other direction, the gap is limited to a maximum of 0.020 inches when the back face of shaft 126 not seen on section 144 meets with its counterpart on section 122.

Surface 146 and surface 138 of section 144, if extended, would meet each other at an 85 degree angle. Cavities formed where these surfaces are below surface 148 combine with cavity 132 of section 120 to form a pathway for the connective structure 134 of section 122. When section 122 is rotated clockwise, surface 146 of section 122 collides with surface 146 of section 144. Likewise, if rotated counterclockwise, surfaces 138 collide, Since 146 and 138 of connective structure 134 of section 122 are also at an 85 degree angle, the rotation possible from one collision to the other is 360-85-85, or 190 degrees.

The flat 136 on the shaft 126 of section 144, a similar flat not seen on the far side of that shaft, and the symmetrical counterparts on section 122 are not advantageous for the function of the pivot, but are rather present to facilitate the molding process by eliminating undercuts. Surfaces that mold the radial surfaces 138 and 146 pass along these flat surfaces as the part is ejected from the mold.

Finger Guards

Figure 8:
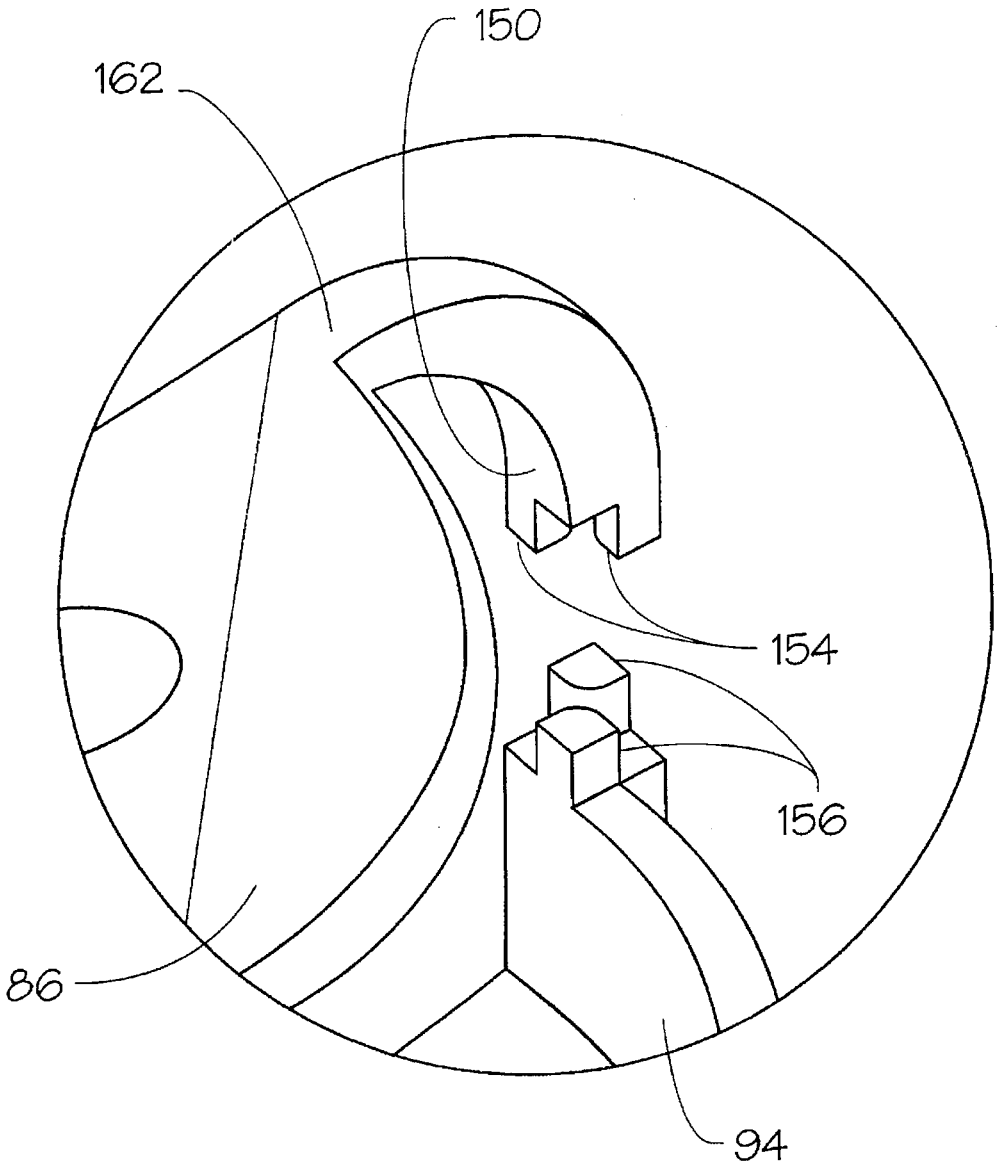
FIG. 8 is a blow-up of a finger guard.

FIG. 8 is a blow-up of a typical finger guard such as 26 in FIG. 2. The function of such guards is to avoid pinching player's finger between opposite edges of neighboring track segments when the pivots rotate. Four tabs, 154 and 156 interlock when an outer part such as 86 is assembled onto an inner part such as 94. Such an interlock is preferred over peg-in-hole arrangements because the interlock discourages rotational motion which might otherwise break finger guard away from the main body of part 86 at point 162. Inside surface 150 is shaped so as to allow passage of a game piece through the track segment formed from the outer and inner parts.

Color

All track segments are filled to capacity with game pieces. If one arrangement of pieces is to be preferred over another, game pieces or groups of game pieces must be distinguishable from others. Since game pieces are spherical, such distinction is most naturally made with color. The desired pattern of color can be identified by also coloring the track segments and require the player to arrange game pieces so that the color of each matches the color of the track segment or portion of track segment which holds the game piece.

For simplicity, each track segment is made one solid color, but each rigid body, having two track segments, can be two colors. Thus in FIG. 6, parts 86 and 94, which form one track segment, can be made a first color. When the puzzle is solved, the colors of game pieces 90 would match this common color. Parts 100 and 104 form the other track segment, and could either share a second color, or share the first color. Either way, the game pieces 102 are expected to match this color.

If the assembled rigid body were viewed from above, the color of parts 86 and 94 would predominate, whereas viewed from below, the color of 100 and 104 would predominate. To study the relationships of colors, a table similar to FIG. 9 can be constructed. The numerical indices correspond to the indices for rigid bodies as in FIG. 2. However, one cannot refer to the colors of a rigid body with the words "above" and "below" as used before. Instead, one can imagine a journey associated with the loop of rigid bodies, taking one from rigid body 1 to rigid body 2, then to 3, 4, 5, 6, and back to 1. Considering the views that are collinear with the rivet of a rigid body, from one of those views, the journey turns to the right at that rigid body, and one track segment is seen.

From the other, to the left, the other is seen. Thus, the words "Right" and "Left" in FIG. 9 distinguish between the segments for each rigid body.

To then determine a color scheme, the most important observation to make is that the line of symmetry of the pivot axes also serves to relate pieces that are in positions symmetrical around the same line. As game pieces move, they cannot break this symmetrical relationship. Therefore, to solve the puzzle, one must consider not only whether a given piece matches its track segment in color, but also whether its symmetrical counterpart matches the symmetrical counterpart of the track segment.

One can respond to this observation by making all symmetrical counterparts the same color. However, the preferred embodiment employs six unordered, binary color combinations of four colors. In FIG. 9, the colors red, blue, yellow, and violet are represented by letters R, B, Y, and V respectively. The symmetrical track segment pair (1-Right,4-Right) is colored (R,B). No other symmetrical pair is colored either (R,B) or (B,R). The other symmetrical pairs are (2-Right,5-Right), (3-Right,6-Right), (1-Left,4-Left), (2-Left,5-Left), and 3-Left,6-Left). Pairs consisting of two of the same color are disallowed.

Many such arrangements are possible. Most were not chosen because of this psychological factor: The puzzle must not seem arbitrary. Grouping the reds, then blues, then yellows, and having violet thrown in at regular intervals seems to most effectively hide the intention to make the puzzle difficult.

Possible Improvements

The blind rivet is not readily available in a ⅛" diameter with a grip length of 0.800. If one builds this device using a rivet, a suitable rivet is needed. McMaster-Carr Supply Company, (310)692-5911, offers an extra-long blind rivet of diameter 0.197, but its grip length starts at 0.984 and goes up. If the entire device were scaled up, this rivet would work. However, one can use the tapered-hex-friction method mentioned above, since the rivet head is large (0.374), and the countersunk hole one makes to accommodate it detracts from the appearance of the device. Solid body conventional soft aluminum rivets are available, but there installation of such a rivet could possibly crush the plastic parts. Clearly, one can always use a screw and nut, and perhaps cover it with epoxy.

There is a need for a toggle mechanism to lock the rigid bodies in place to facilitate movement of game pieces. Something might be arranged at the abutment of symmetrical pairs (such as rigid bodies 2 and 5 of FIG. 2). Clearly, the device will function without this feature. An alternative is to merely build up these surfaces to touch. Player can grasp the device so as to hold these surfaces together, and resulting surface friction will hold all rigid bodies motionless.

Closing Remarks

Although the description of the preferred embodiment of the present device has been quite specific, it is contemplated that various modifications could be made to the device illustrated without deviating from the spirit of the present invention. Consequently, it is intended that the scope of the present application be limited by the appended claims rather than by the description of the preferred embodiment.

I claim:

1. A mechanical puzzle comprising six rigid bodies attached in a closed loop via pivot mechanisms, each said rigid body holding two of said pivot mechanisms so that axes of said mechanisms remain in rigid relation to each other, said axes forming a group which is symmetrical about a single line of symmetry, said rigid bodies having track segments on their surface said track segments continuing across said bodies, said track segments on a particular body aligning with said track segments on another body, said track segments retaining game pieces movable along said track segments, said pieces movable from one body to another body by way of alignment of said track segments, the degree of pivoting of said bodies determining which of said track segments align.

2. The mechanical puzzle of claim 1 wherein six of said track segments, one on each rigid body, can be aligned into a closed track, thereby allowing said game pieces to be moved along said closed track, and which loop of said rigid bodies may be moved to other orientations, also forming a closed track while involving other collections of track segments, said bodies being shaped so as to block the exit of said game pieces from said puzzle, all track segments being filled to capacity with said game pieces, such that said game pieces cannot move along said track segments, except when said track segments align to form said closed track.

* * * * *